US005622161A

United States Patent [19]

Stack

[11] Patent Number: 5,622,161

[45] Date of Patent: Apr. 22, 1997

[54] STOVE

[75] Inventor: Michael Stack, Cappagh, Ireland

[73] Assignee: Waterford Foundry (Inventions) Limited, Waterford, Ireland

[21] Appl. No.: 597,920

[22] Filed: Feb. 7, 1996

[30] Foreign Application Priority Data

Feb. 8, 1995 [IE] Ireland ..... S950101

[51] Int. Cl.[6] ..... F24C 1/14

[52] U.S. Cl. ..... 126/77

[58] Field of Search ..... 126/77, 58

[56] References Cited

U.S. PATENT DOCUMENTS 4,329,930 5/1982 Riley .
4,337,753 7/1982 McGinn .
4,475,533 10/1984 Milligan .
4,665,889 5/1987 Rumens et al. .
4,683,868 8/1987 Ferguson et al. .
4,766,876 8/1988 Henry et al. .
5,357,941 10/1994 Duerichen et al. ..... 126/77

*Primary Examiner*—Carroll B. Dority
*Attorney, Agent, or Firm*—Hoffmann & Baron

[57] ABSTRACT

A stove (1) for the combustion of solid fuel (4), such as wood, a fire box within the stove forming the combustion chamber (2) for the fuel is provided with a hollow hood (20) extending over the combustion chamber. A primary air inlet (7) and channel provide a supply of air to the combustion chamber for primary combustion and a secondary air inlet (9) and channel provide a supply of air to the hollow hood (20). The hollow hood has a multiplicity of air exit apertures (32) distributed across the lower surface (25) of the hood to provide air for secondary combustion in the upper region of the fire box. A flue gas exit orifice (36) is provided in the hood, the orifice being defined by a hole in both the lower surface (25) and upper surface of the hood, the holes being connected by a wall or walls (37) with a plurality of apertures (39) therein. Air is thereby supplied to the flue gases (10) exiting through the orifice (36) enabling secondary combustion to occur in the orifice.

5 Claims, 5 Drawing Sheets

STOVE

The present invention relates to a stove for solid fuel, and particularly though not exclusively to a wood burning stove.

The standards applicable to the use of stoves are becoming more and more stringent, particularly with regard to the amount of smoke generated by the combustion process. In the United States of America, the standard for non-catalytic wood burning stoves requires an emission of no more than 7.5 grams per hour; for catalytic stoves the rate is 4.0 grams per hour. To achieve such a low emission level requires very efficient combustion of the fuel in the stove which is very difficult to achieve. The usual method of achieving efficient combustion is to provide for primary combustion of the fuel and secondary combustion of the volatile and combustible matter in the smoke and gases produced by the primary combustion of the fuel.

The present invention provides a stove for the combustion of solid fuel, such as wood, comprising a fire box within the stove forming a combustion chamber for the fuel; a hollow hood having an upper surface and a lower surface extending over the combustion chamber; a primary air inlet and channel for providing a supply of air to the combustion chamber for primary combustion; a secondary air inlet and channel for providing a supply of air to the hollow hood; the hollow hood having a multiplicity of air exit apertures distributed across the lower surface of the hood to provide air for secondary combustion in the upper region of the fire box, and a flue gas exit orifice defined by a hole in both the lower surface and upper surface of the hood, the holes being connected by a wall or walls with a plurality of apertures being provided in the wall or walls of the orifice; whereby air is supplied to the flue gases exiting through the orifice thereby enabling secondary combustion to occur in the orifice.

Advantageously, a baffle plate is located at an air entry port of the hood so as to distribute the supply of air through the hood including the regions remote from the entry port.

Advantageously, the lower surface of the hood is of stepped construction having a series of treads and risers and in which the apertures are located in the risers of the stepped surface.

The invention will now be described more particularly with reference to the accompanying drawings which show, by way of example only, one embodiment of fuel stove of the invention.

Figure 1:
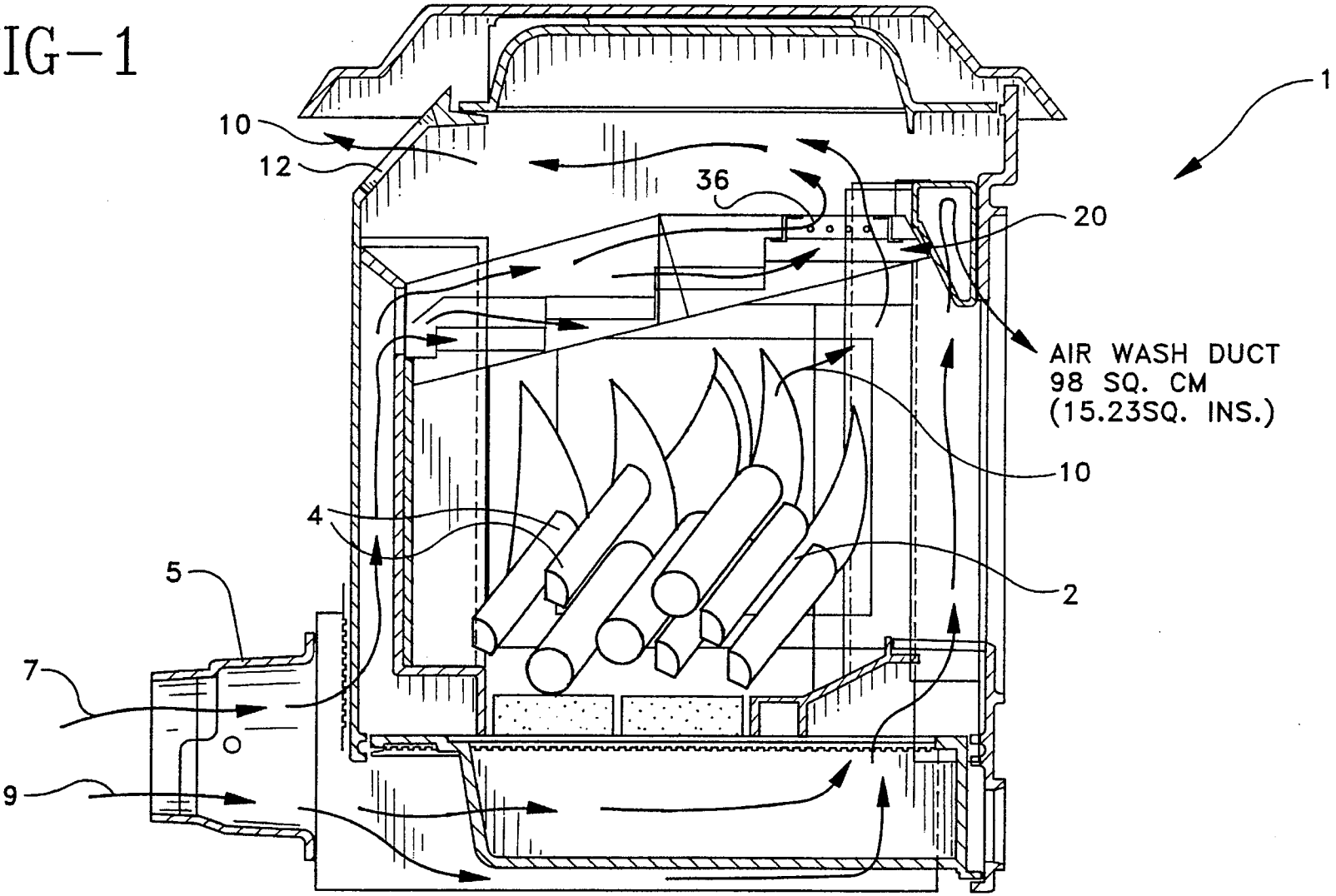
Figure 2:
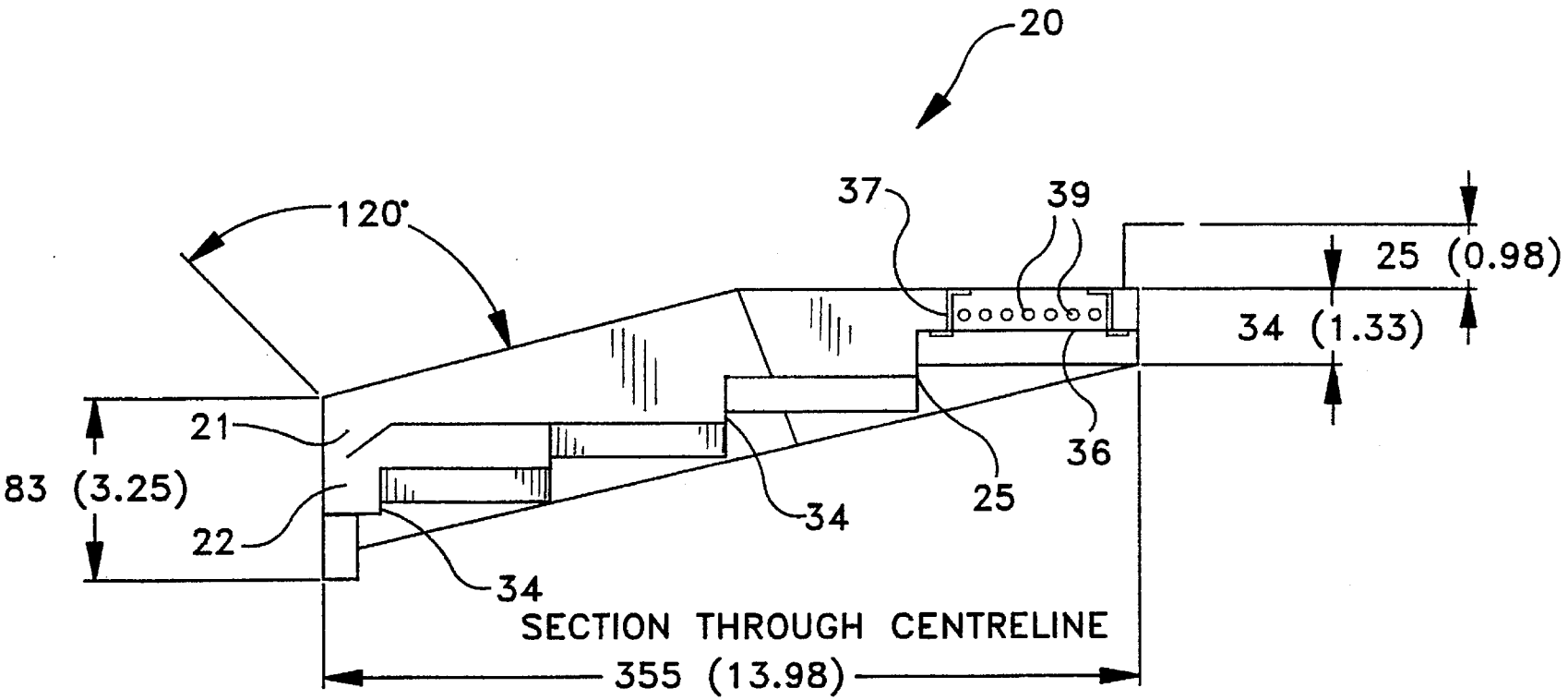
Figure 2A:
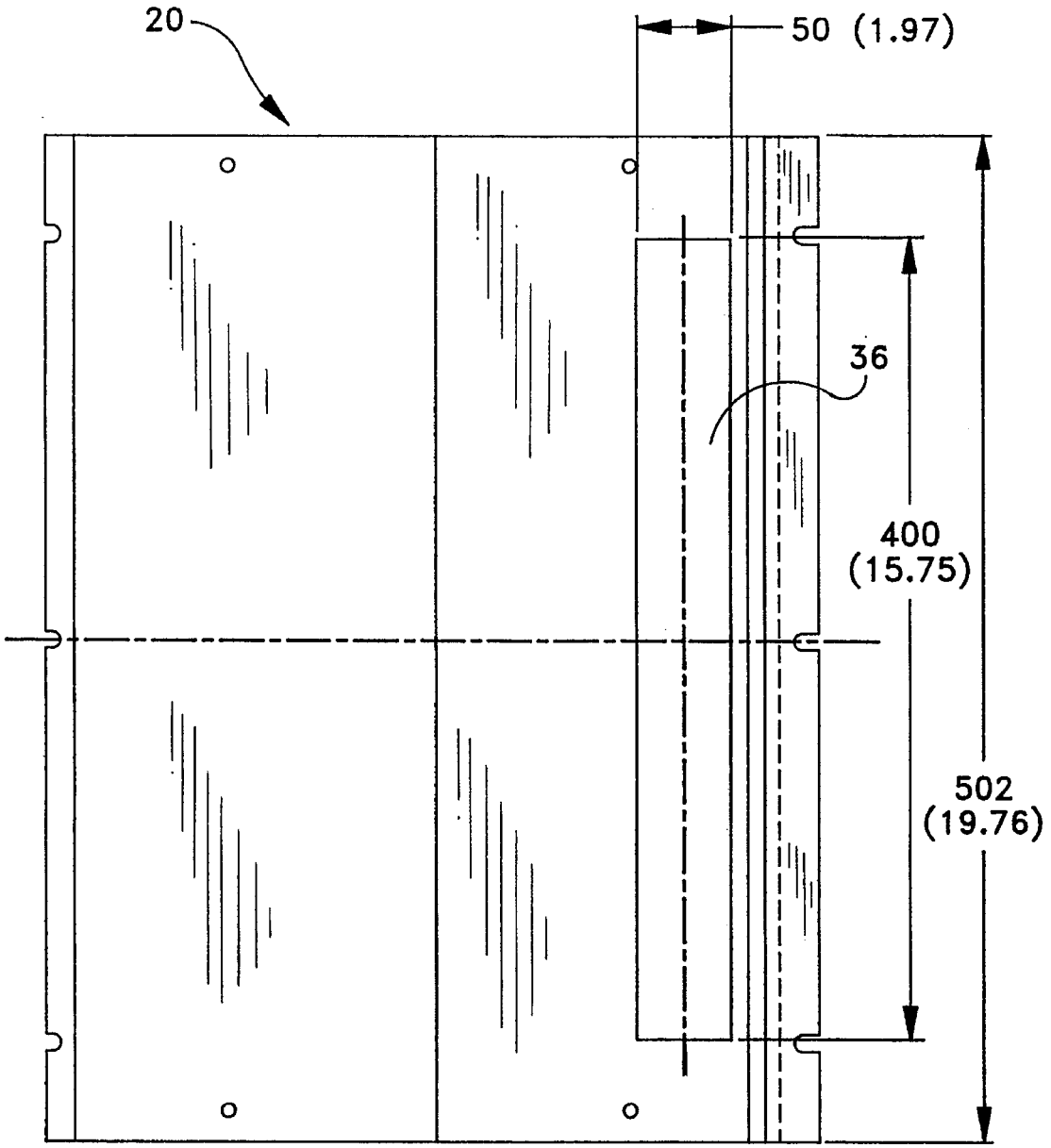
Figure 3:
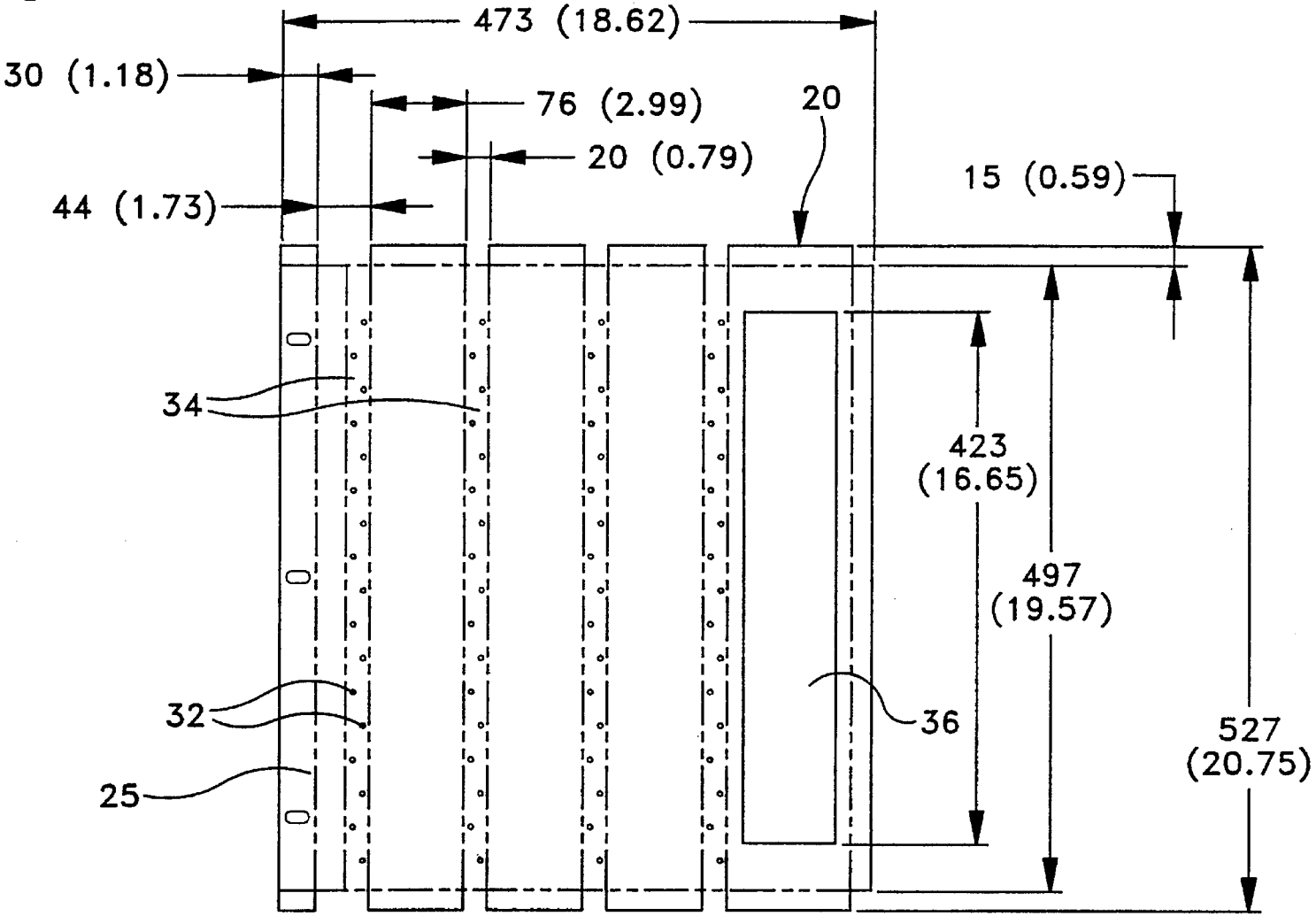
Figure 3A:
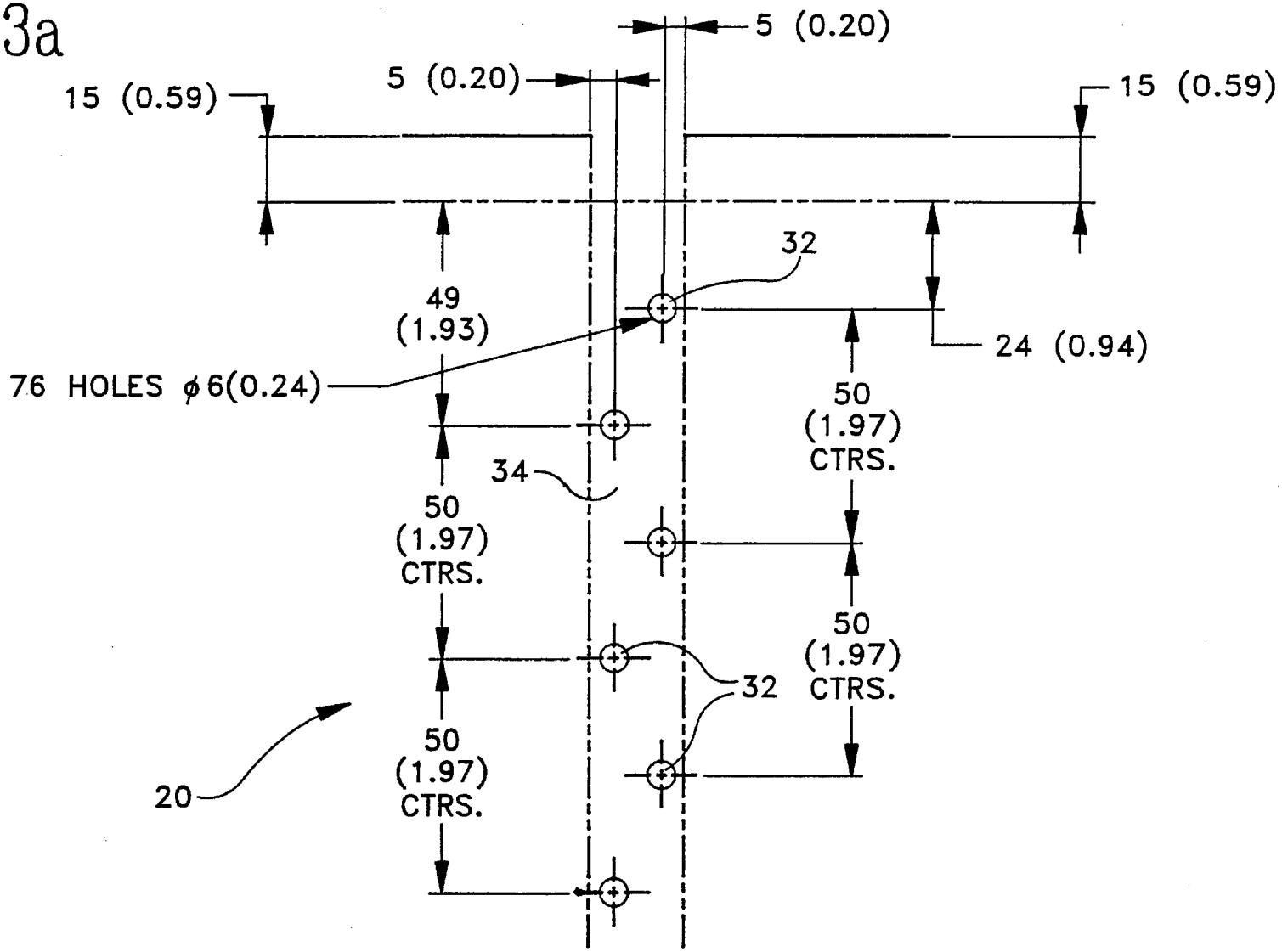

FIG. 1 is a sectional side elevation of a fuel stove having a secondary air hood;

FIGS. 2 and 2*a* are a detailed sectional side elevation and a plan view of the hood of FIG. 1; and FIGS. 3 and 3*a* are a plan view and a detailed plan view of a blank for forming a stepped plate of FIG. 1.

Referring to the drawings and initially to FIG. 1, the fuel stove 1 has a combustion chamber 2 for burning fuel 4. An inlet cowl 5 is split to form a primary air inlet 7 and a secondary air inlet 9 to encourage primary and secondary combustion of the fuel, respectively.

When primary combustion takes place, unburnt residues of the fuel are carried in the hot rising air 10 which flows towards a flue exit 12. In flue gases, the residue from primary combustion comprises mostly particles of unburnt fuel. The flue gases in which these particles are carried is oxygen deficient, preventing further combustion. By providing a secondary air supply into the flue gases, further combustion may occur spontaneously. Air from the secondary inlet 9 is directed to the upper part of the combustion chamber 2 to be evenly fed into the residue laden air 10 to provide sufficient oxygen for secondary combustion.

To evenly feed the secondary air to the combustion chamber, an air flow hood 20, as illustrated in FIGS. 2 and 2*a*, is provided in the upper region of the combustion chamber 2. The air hood 20 comprises first and second inlet flow paths 21,22 formed between baffle 17 and includes a lower stepped metal plate 25 formed from a blank shown in FIGS. 3 and 3*a*. A series of apertures 32 are provided in the vertical sections 34 of the stepped plate 25. The inlet paths 21,22 direct the secondary air to the apertures 32 so that the air is drawn through the apertures 32 equally.

A flue gas outlet orifice 36 is defined in the hood 20 and is provided with walls 37 in which there are disposed a further series of apertures 39. These walls surround and confine the outlet 36 so that flue gases and secondary air are concentrated within the outlet. Any remaining unburnt combustible residues in the flue gases 10 is now provided with sufficient oxygen to burn. A sustained secondary combustion may occur at the outlet 36 to provide a "ring of fire" effect through which little combustible residue may pass.

The hood 20 is manufactured from stainless steel and is resistance welded to form an air tight box apart from the apertures 32.

It will of course be understood that the invention is not limited to the specific details described herein, which are given by way of example only, and that various modifications and alterations are possible within the scope of the appended claims.

I claim:

1. A stove for the combustion of solid fuel, such as wood, comprising a fire box within the stove forming a combustion chamber for the fuel; a hollow hood having an upper surface and a lower surface extending over the combustion chamber; a primary air inlet and channel for providing a supply of air to the combustion chamber for primary combustion; a secondary air inlet and channel for providing a supply of air to the hollow hood; the hollow hood having a multiplicity of air exit apertures distributed across the lower surface of the hood to provide air for secondary combustion in the upper region of the fire box, and a flue gas exit orifice defined by a hole in both the lower surface and upper surface of the hood, the holes being connected by a wall or walls with a plurality of apertures being provided in the wall or walls of the orifice; whereby air is supplied to the flue gases exiting through the orifice thereby enabling secondary combustion to occur in the orifice.

2. A stove as claimed in claim 1, in which a baffle plate is located at an air entry port of the hood so as to distribute the supply of air through the hood including the regions remote from the entry port.

3. A stove as claimed in claim 1, in which the hood is manufactured from stainless steel and is resistance welded to form an air tight box apart from the apertures.

4. A stove as claimed in claim 1, in which the lower surface of the hood is of stepped construction having a series of treads and risers and in which the apertures are located in the risers of the stepped surface.

5. A stove as claimed in claim 1, having an air inlet cowl which is divided to form the primary air inlet and the secondary air inlet.

* * * * *